United States Patent [19]

Tamiya et al.

[11] Patent Number: 4,509,441

[45] Date of Patent: Apr. 9, 1985

[54] SEWING MACHINE WITH AN AUTOMATIC BUTTONHOLE STITCHING DEVICE

[75] Inventors: Yoshimichi Tamiya; Yasukata Eguchi, both of Tokyo, Japan

[73] Assignee: Janome Sewing Machine Co. Ltd., Tokyo, Japan

[21] Appl. No.: 396,692

[22] Filed: Jul. 9, 1982

[30] Foreign Application Priority Data

Jul. 16, 1981 [JP] Japan ..... 56-110039

[51] Int. Cl.[3] ..... D05B 3/02

[52] U.S. Cl. ..... 112/158 B; 112/158 E

[58] Field of Search ..... 112/158 B, 158 E, 158 A, 112/275, 277, 121.11

[56] References Cited

U.S. PATENT DOCUMENTS

| | | | |
|---|---|---|---|
| 4,100,865 | 7/1978 | Landau, Jr. et al. | 112/121.11 |
| 4,250,821 | 2/1981 | Miyao et al. | 112/158 E X |
| 4,256,047 | 3/1981 | Suzuki et al. | 112/277 X |
| 4,265,188 | 5/1981 | Suzuki et al. | 112/158 B |

*Primary Examiner*—Peter Nerbun

*Attorney, Agent, or Firm*—Michael J. Striker

[57] ABSTRACT

Stitches have once been formed in a sewing machine in four steps to produce a buttonhole, the number of the stitches to be used in each of the steps are stored in a memory, and the stitches in each step are formed with the number of stored stitches for following buttonhole such that all sizes of the buttonholes are made of the same size. The sewing machine is provided with a central circuit which includes a pattern selecting device which selects a cam from a plurality of pattern cams in correspondence to stitching of the designated step in producing the buttonholes. An electronic control device provided in the sewing machine stores the number of stitches formed in accordance with each of the steps with the memory designation, and a stitching mode check device designates a subsequent step in each of the steps. An indicating device provided in the central circuit indicates this designation, and the buttonhole is repeatedly formed. A machine motor control circuit stops a machine motor at completion of the number of stitches stored in each step and the machine motor again starts with selection of new patterns of the stitches.

3 Claims, 2 Drawing Figures

SEWING MACHINE WITH AN AUTOMATIC BUTTONHOLE STITCHING DEVICE

BACKGROUND OF THE INVENTION

The invention relates to a sewing machine with an automatic buttonhole stitching device, and more particularly to a device which includes a plurality of pattern cams for producing stitches in each of the steps in stitching a buttonhole, and a member for storing the number of stitches with an electronic control device.

The stitches are formed in sequence formed by selecting a pattern cam from the plurality of cams by a pattern selecting operation, designating memory in advance, and storing the number of stitches having been formed in each of the stitching steps of the buttonhole. Subsequent or following buttonholes are formed in succession with the number of stored stitches, is that a plurality of buttonholes of the same size are automatically produced.

Generally, this kind of the buttonhole stitching is performed with a pattern selecting operation, e.g., 4 steps. In the 1st step pattern is selected, and a right line-track of a determined length is formed on a fabric to be sewn. A bar-tack is selected in the 2nd step, and is formed with the number of stitches. In the 3rd step a left line-track is selected and is formed to be of the same length as that of the right line-tack previously formed. Finally, as a 4th step a bar-tack is selected and is formed with the number of stitches. Thus, one buttonhole is completed. A buttonhole of the same size is in succession formed through the same operation as said. However, formation of a plurality of buttonholes of the same size has not been easy in the prior art.

SUMMARY OF THE INVENTION

It is an object of the present invention to provide an automatic buttonhole stitching device, wherein once formed stitches are produced in the above mentioned four steps of forming a buttonhole, the number of stitches in each of the steps are stored, and the stitches in each step are formed with the number of stored stitches for subsequent buttonholes such that the sizes of the buttonholes are uniform, and wherein a pattern selecting device selects a cam from the plurality of pattern cams in correspondence to stitching of the designated step in the buttonhole, an electronic control device stores the number of stitches formed in response to each of the steps with the memory designation, a stitching mode check device designates a subsequent step in each of these steps, and an indicating device indicates this designation, and wherein the buttonhole is repeatedly formed, and wherein a machine motor control circuit stops a machine motor at completion of the number of stitches stored in each step and the machine motor again starts with selection of new patterns.

DETAILED DESCRIPTION OF THE PREFERRED EMBODIMENTS

Figure 1:
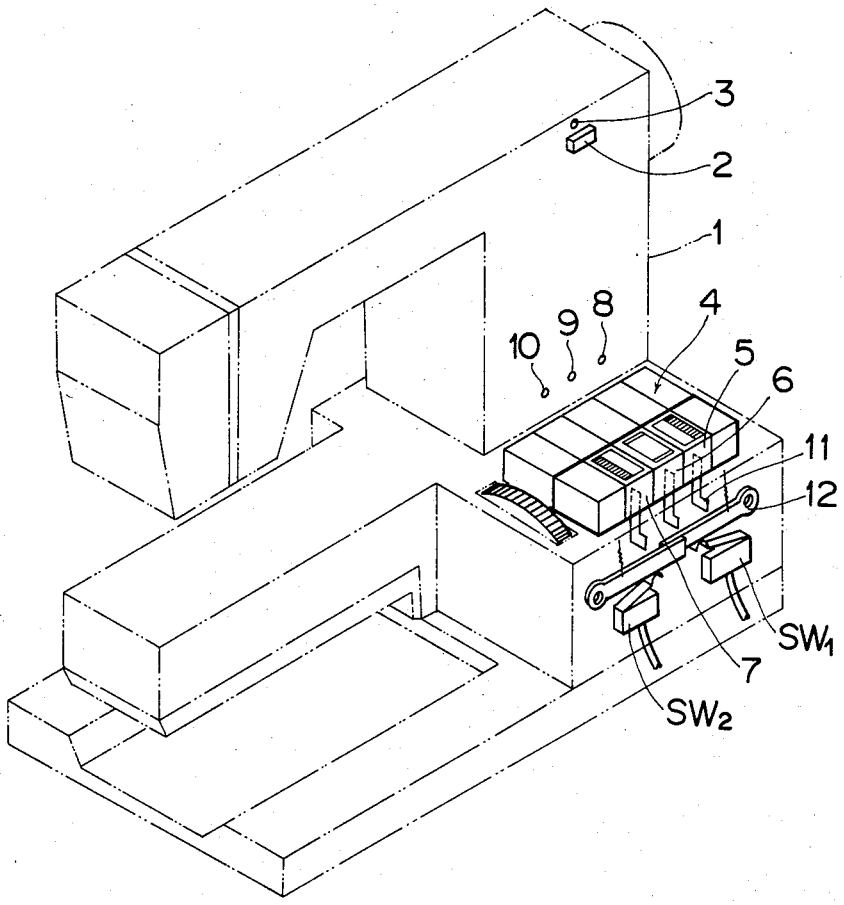
FIG. 1 is a schematic perspective view of a sewing machine illustrating examples of the invention and FIG. 2 is a diagrammatic view of a control circuit of the sewing machine.

Embodiments of the invention will be explained in reference to the attached drawings. FIG. 1 shows an element part of a pattern selecting device, in which reference numeral 1 denotes a machine body and 2 designates a memory button. When pushing the button 2 designation is made to store the number of stitches to be used in each of the steps for forming the buttonhole, and designation is cancelled by re-pushing button 2. The numeral 3 is an indicating lamp of stored stitches, which indicates designation of the number of said stored stitches and stitches to be repeated by memorization, in different indication. 4 is a pattern selection button of the pattern selecting device, the button is maintained in a pushed position by a pushing operation which in turn releases other buttons. Pattern cam selecting buttons 5, 6 and 7 designate respectively the right line-tack of the 1st step, the bar-tacks of the 2nd and 4th steps and the left line-tack of the 3rd step. Indicating lamps 8, 9 and 10 indicate by different indications that a present step is in use or that another step is ready for a following process as designated by a stitching mode check device. (SW1)(SW2) are switches for generating pattern selecting signals, and the switch (SW1) is closed by pushing the button 5. The button 6 closes both switches (SW1)(SW2), and the button 7 closes the switch (SW2). Levers 11 and 12 are for actuating the buttons 5, 6, 7 on the switches (SW1)(SW2).

Figure 2:
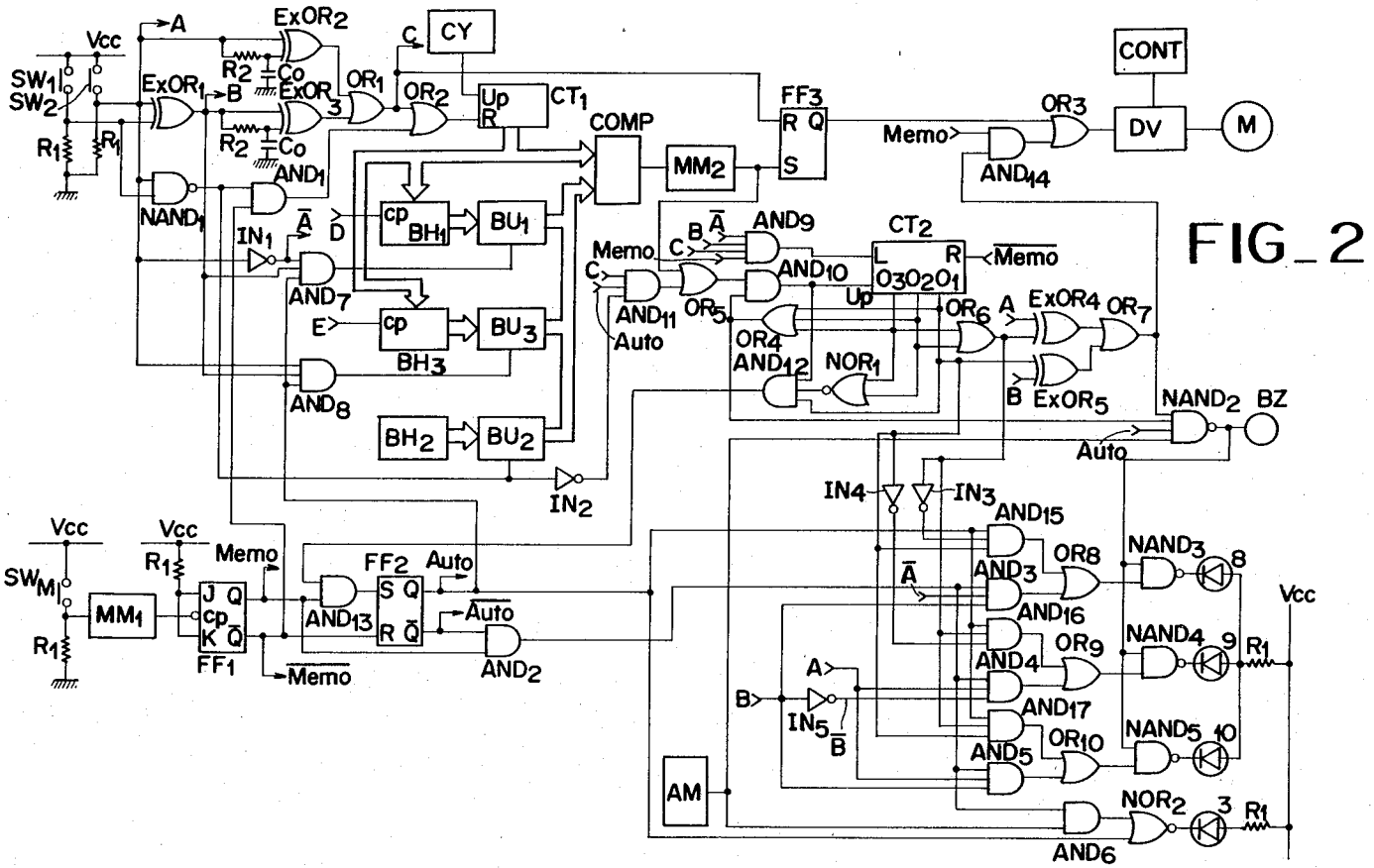

FIG. 2 is a control circuit. ($SW_M$) is a memory designating switch. The switch ($SW_M$) is temporarily closed by pushing the memory button 2. When a rising signal is given via a monostable multivibrator (MM1), to a close input terminal (Cp) of JK flipflop circuit (FF1), the switch inverts output of the flipflop circuit (FF1). When a signal Memo of a true side terminal (Q) thereof is logic 1 the switch ($SW_M$) designates the stored stitches. (Vcc) is a controlling plus power source, and (R1) is a pull-up resistor.

When the pattern selecting button 5 is pushed, the switch (SW1) is closed and the switch (SW2) is opened. Then, output signal A is logic 1, and output signal B passing via an exclusive OR circuit (ExOR1) is logic 1. When the button 6 is pushed, the switches (SW1)(SW2) are closed. Then, the signals A and B are 1 and 0, respectively. When the button 7 is pushed, the switch (SW1) is opened and the switch (SW2) is closed. Then, the signals A and B are 1 and 1, respectively. Each of the couples of these signals designates each of the respective steps of the buttonhole stitching.

When the buttons 5, 6, 7 are newly pushed, any one of the signals A and B is inverted. This new pushing is detected by couples of resistors (R2) and capacitors (Co), since the preceding condition is temporarily maintained for a charging time of the capacitors (Co), and the couples of the inverted signals and the signals in said preceding condition are received by exclusive OR circuits (ExOR2)(ExOR3), respectively, and when any of the output signals is logic 1, the output signal C of OR circuit (OR1) is 1.

(CT1) is a counter for controlling the number of stitches, which receives a signal C at a reset terminal (R) via OR circuit (OR2). Or in the designation of the lock stitch, not the stored stitch, the counter (CT1) is reset by receiving the signal from AND circuit (AND1) which inputs signal $\overline{\text{Memo}}$ of logic 1 from a complement side terminal ($\overline{Q}$) of the flipflop circuit (FF1). In this case, the output of NAND circuit (NAND1) is 0 to designation of the bar-tack where the switches (SW1)(SW2) are both closed as mentioned later, and said output is given to the other input of AND circuit (AND1) such that said reset signal is not given thereto.

The counter (CT1) receives, at its count-up terminal (Up), a signal of a synchronizing signal generating a device (CY) which generates pulse signal per rotation in synchronism with rotation of an upper shaft of the sewing machine, and counts up the number of the stitches to be formed. That is to say, with respect to the stored stitches, operations of the switches (SW1)(SW2) are 0, and the number of the stitches to be subsequently formed are counted up per each step, while with respect to the ordinary lock stitch on the other hand, counting-up is carried out on the number of stitches in stitching the bar-tack when the switches (SW1)(SW2) are closed.

RS flip-flop circuit (FF2) receives signal $\overline{\text{Memo}}$ and is reset. AND circuit (AND2) receives signal $\overline{\text{Auto}}$ from the complement side output terminal ($\overline{Q}$) of the flip-flop circuit (FF2) and signal Memo, and gives the logic 1 as inputs of AND circuits (AND3)-(AND6) until the final 4th step is completed in the initial buttonhole stitching.

(BH1) is a latch circuit of the number of stitches in the 1st step, which receives output from the counter (CT1). The latch circuit (BH1) receives output D at Cp from the AND circuit (AND3) and latches the number of stitches in the 1st step, while the AND circuit (AND3) puts out the logic 1 signal of the AND circuit (AND2) and signal $\overline{A}$ by inverting signal A through the inverter (IN1) and signal B which are 1, respectively, in the 1st step, and issues the output D. (Cp) is a clock input terminal of latch circuit (BH1). (BH3) is a latch circuit of the number of stitches in the 3rd step, which receives signal E showing the 3rd step in use, from AND circuit (AND5) and latches the number of stitches under formation. (BH2) is a storing device of the number for stitches in the 2nd and 4th steps, and in the present case 7 stitches are stored.

(COMP) is a comparator which receives output from the counter (CT1) at one side input, and receives output signals of the latch circuits (BH1) (BH3) and the memory (BH2) via buffers (BU1),(BU3),(BU2) at the other input side, and when these signals meet one another, the monostable multivibrator (MM2) is actuated. Comparison is not made on 0 and 0, respectively. The buffers (BU1)(BU3) are opened at gates when outputs of AND circuits (AND7),(AND8) are logic 1. These AND circuits receive output Auto from the true side of the flipflop circuit (FF2), while signals D and E of the AND circuits (AND3),(AND5) are issued as the signals of the 1st and 3rd steps of the initial buttonhole stitching, and 1 is produced as signals of the 1st and 3rd steps of subsequent buttonhole stitching. A buffer (BU2) receives signal from the NAND circuit (NAND1). A flipflop circuit (FF3) receives signal C at its reset terminal (R), which is opened at the gate in the 2nd and 4th steps where the switches (SW1),(SW2) are both closed. The flipflop circuit (FF3) is reset per operation of the switches (SW1)(SW2), and receives the signal of the monostable multivibrator (MM2) at the reset terminal (S), and receives the meeting signals of the comparator (COMP), and is set. In this setting, the output Q designates a motor driving circuit (DV) via OR circuit (OR3) to stop a motor (M).

(CONT) is a speed controller which causes a motor drive circuit (DV) to control speed of the motor (M) when output of the OR circuit (OR3) is 0. (CT2) is a pentad system counter for checking mode of the buttonhole stitching, which receives signal $\overline{\text{Memo}}$, and its outputs $O_3$, $O_2$, $O_1$ are reset 0, 0, 0. The counter (CT2) receives, at a load terminal (L), output of AND circuit (AND9) which receives signals $\overline{A}$, B, C, $\overline{\text{Memo}}$, and loads 0, 0, 1 when the load terminal (L) is 1, that is, when the 1st step of the buttonhole is designated. The count-up terminal (UP) of counter (CT2) receives the output of AND circuit (AND10). The AND circuit (AND10) receives, at its one input, output from OR circuit (OR 4) where the 1st step to 4th step are 1, and receives, via OR circuit (OR5), outputs of the monostable multivibrator (MM2) and AND circuit (AND11). The AND circuit (AND11) receives an inverted signal of NAND circuit (NAND1) passing via the inverter (IN2), and the signal C and the signal $\overline{\text{Auto}}$. With respect to the initial buttonhole stitching, when the switches (SW1)(SW2) are closed for designating the 2nd step and the 4th step with output of the AND circuit (AND11), the counter (CT2) counts up the number of stitches, and since the counter (CT2) counts up with the output of the monostable multivibrator (MM2), it counts up the number of stitches per each of the steps. With respect to subsequent buttonhole stitchings, the counter (CT2) counts up per switching each of the steps via the monostable multivibrator (MM2). Result of the counting-up at finishing of the 4th step renders outputs $O_3$, $O_2$, $O_1$ of the counter (CT2) 0 0 0 .

With respect to a couple of NOR circuit (NOR1) and AND circuit (AND12), when the monostable multivibrator (MM2) issues a signal finishing the 4th step under a condition that the counter (CT2) renders outputs $O_3$, $O_2$, $O_1$ thereof 1, 0, 0 for designating the 4th step, output of the AND circuit (AND12) sets the flipflop circuit (FF2) via AND circuit (AND13). When logic 1 is signal Auto of the true side output terminal (Q) of the flipflop circuit (FF2), it means stitching of the subsequent buttonhole stitchings.

An Exclusive OR circuit (ExOR4) compares upper 2 bits $O_3$, $O_2$ of the counter (CT2) with signal A via OR circuit (OR6), and an exclusive OR circuit (ExOR5) compares lower bit 01 of the counter (CT2) with signal B, and if the comparisons are not met, these exclusive OR circuits give 1 to AND circuit (AND14) and stop motor (M). If an error is made in operation order of the buttons 5, 6, 7, the motor (M) is not worked then.

(BZ) is a buzzer which issues buzzing when each of the steps is finished or the step is designated by error for making fresh operation, and which receives a signal from NAND circuit (NAND2) and works when the signal is 0. The NAND circuit (NAND2) receives signal a of astable multivibrator (AM) to cause the buzzer (BZ) to sound on and off.

The lamp 3 indicates that the buttonhole is made by the stored stitches, and lights when NOR circuit (NOR2) is 0. The NOR circuit (NOR2) receives the output of the AND circuit (AND6) at its input, and receives signal of the astable multivibrator (AM) to make the indicating lamp 3 light on and off during the initial buttonhole stitching. The NOR circuit (NOR2) receives at the other input the signal Auto to continuously lighten the lamp (3) during subsequent buttonhole stitching. When the 1st step indicating lamp 8 continuously lights, it indicates the duration of the right line-tack stitching of the 1st step, and it lights when NAND circuit (NAND3) is 0. The NAND circuit (NAND3) receives the output of the NAND circuit (NAND2), and receives on-and-off signal due to erroneous operation by designation when OR circuit (OR7) is 1, that is, during stitching the 1st step, and receives the signal 1 at the normal operation.

NAND circuit (NAND3) receives the output of OR circuit (OR8) which receives the outputs of AND circuits (AND3)(AND15). AND circuit (AND3) is 1 by designation of the 1st step in the initial buttonhole stitching so that the indicating lamp 8 lights continuously. Outputs $O_3$ $O_2$ $O_1$ of the counter (CT2) are 0 0 1 during stitching the 1st step in subsequent buttonhole stitching. AND circuit (AND15) receives the output of OR circuit (OR16) via the inverter (IN3) to render this output 1, and receives signals $O_3$, AUto to render them 1. Thus, when the step is designated by error, OR circuit (OR7) is 1 to make the indicating lamp light on and off.

When the indicating lamp 9 of the 2nd and 4th steps lights continuously, it indicates that the bar-tack stitching is made on the 2nd or 4th step. When the lamp 9 lights on and off, it indicates that designation is made to operate the 2nd and the 4th steps, and that erroneous operation is made by designation of the other step during stitching each of the steps. The indicating lamp 9 lights when NAND circuit (NAND4) is 0. The NAND circuit (NAND4) receives, at its one side, the output of NAND circuits (NAND2), similarly to NAND circuit (NAND3), and receives an on-and-off signal by erroneous operation in designation of the step, and receives the signal 1 at the normal operation. NAND circuit (NAND4) receives, at the other side, the output of OR circuit (OR9) which receives outputs of AND circuits (AND4)(AND16). An inverter (IN5) inverts a signal B into $\overline{B}$, and AND circuit (AND4) receives the inverted signal $\overline{B}$ by said step designation in the initial buttonhole stitching. The inverted signal $\overline{B}$ is rendered 1 to light the indicating lamp 9 continuously. The outputs $O_3$ $O_2$ $O_1$ of the counter (CT2) are 0, 1, 0 or 1, 0, 0 in said step of subsequent buttonhole. AND circuit (AND16) renders all inputs 1, including the connection via the inverter (IN4), to that of similar AND circuit (AND15). Since OR circuit (OR7) is rendered 1 by erroneous operation in finishing said step and designating the step, the indicating lamp 9 lights on and off.

When the indicating lamp 10 of the 3rd step lights continuously, it shows the duration of stitching the left line-tack of the 3rd step, and when it lights on and off, it shows designation to perform the operation of the 3rd step and an erroneous operation by designation of the other wrong step during stitching said step, and the lamp 10 lights when NAND circuit (NAND5) is 0. AND circuit (AND17) and OR circuit (OR10) serve the same functions as AND circuits (AND15),(AND16) and OR circuits (OR8), (OR9).

A further reference will be made to actuation of the above mentioned circuit. When a control electric source is supplied, the flipflop circuits (FF1),(FF2),(FF3) are reset, and the counters (CT1)(CT2) and the latch circuits (BH1),(BH3) are reset 0. When the memory designation button 2 is pushed to close the memory designation switch (SWM), JK flipflop circuit (FF1) is set. The buttonhole storing indicating lamp 3 lights on and off with the on-and-off signal via AND circuit (AND6), NOR circuit (NOR2) and others, and indicates that the stored stitching is for the initial buttonhole. When the pattern selecting button 5 is pushed to designate the right line-tack as the 1st step of the buttonhole, the pattern selecting signal switch (SW1) is closed. During this operation, the output signal C of OR circuit (OR1) is 1, and the signals A, B showing operation of the switch are maintained at logic 0, 1.

1 is the signal Memo of the true side output terminal (Q) of the flipflop circuit (FF1), and the AND circuit (AND9) receives 1 of the signals B, C, Memo and 1 of the inverted signal $\overline{A}$, and loads the outputs $O_3$ $O_2$ $O_1$ of the stitching mode check pentad counter (CT2) 0, 0, 1. The signal C resets the counter (CT1) via OR circuit (OR2), and resets the flipflop circuit (FF3) and renders 0 the output Q thereof to enable starting of the machine motor (M). The 1st step indicating lamp 8 lights with the signal from AND circuit (AND3) and others. When the speed controller (CONT) is operated to drive the sewing machine, the counter (CT1) counts up the number of stitches per rotation of the upper shaft of the sewing machine and counts up the number of formed stitches. Since 1 is the output signal D of AND circuit (AND3) during operation of the 1st step, the latch circuit (BH1) of the number of stitches in the 1st step latches anew the number of said stitches per rotation of the sewing machine. When the right line-tack reaches the desired length, the sewing machine is stopped thereby. When the pattern selecting button 6 is operated to designate the bar-tack as the 2nd step of the buttonhole, the pattern selecting signal issuing switches (SW1),(SW2) are closed, and the signals A, B are rendered 1, 0, respectively. The latch circuit (BH1) has latched the number of final stitches. The indicating lamp 9 lights with the signal from AND circuit (AND4) to indicate the 2nd and the 4th steps. The device (BH2) storing the number of stitches in the 2nd the 4th steps is opened at its gate via NAND circuit (NAND1), and gives a number 7 to the comparator (COMP). The counter (CT1) is reset. The counter (CT2) counts up the number of stitches via AND circuit (AND11) and others, and its output is produced 0, 1, 0. When the sewing machine is driven and counting of said counter becomes 7, the comparator (COMP) outputs 1 and counts up the counter (CT2) to produce its outputs 0, 1, 1, and sets the flipflop circuit (FF3) and stops the motor (M). When the pattern selecting button 7 is pushed to designate the left line-tack as the 3rd step of the buttonhole, the switch (SW1) opens and the switch (SW2) closes, and the signals A, B are made 1, 1. The indicating lamp 10 of the 3rd step lights by the signal from AND circuit (AND5) and others. The counter (CT1) is reset, the flipflop circuit (FF3) is also reset, and the motor (M) is enabled to start. When the sewing machine is driven, the counter (CT1) is counted up. Since the output signal E of AND circuit (AND5) is 1, the latch circuit (BH3) of the number of stitches of the 3rd step latches anew the number of said stitches in performing the 3rd step. When the left line-tack reaches the desired length, the sewing machine is stopped. When the button 6 is again pushed to designate the bar-tack as the 4th step of the buttonhole, the same condition may be provided as in the 2nd step. The latch circuit (BH3) has latched the number of the final stitches formed in the 3rd step, and the counter (CT2) produces the outputs 1, 0, 0 with counting up. When the sewing machine is driven to provide the counting 7 of the counter (CT1), the motor (M) is stopped, and the counter (CT2) is counted up to be 0, 0, 0, and the flipflop circuit (FF2) is set via AND circuits (AND12)(AND13). The true side output Auto thereof is 1 and switches the indicating lamp 3 to continuous lighting via NOR circuit (NOR2).

A further explanation will be given with respect to automatic formation of buttonholes of the same size as that of the above mentioned buttonhole. When the operating button 5 is pushed, the switch (SW1) is closed and the signals A, B are produced 0, 1. The counter (CT1) is reset, and the motor (M) is started, and the output of the counter (CT2) is produced 0 0 1. The indicating lamp 8 is continuously lighted by the signal from AND circuit (AND15) and other. The latch circuit (BH1) is opened at its gate by the signal from AND circuit (AND7) and others, and gives to the comparator (COMP) the number of stitches of the above mentioned right line-tack. When the sewing machine is driven to form stitches of the right line-track and the value of the counter (CT1) meets the number of said stitches, the comparator (COMP) has output 1 to stop the motor (M), and the output of the counter (CT2) are 0 1 0 and the lamps 8 turns off. OR circuit (OR7) is 1, and NAND circuit (NAND2) issues an on-and-off signal to work the buzzer (BZ) discontinuously. NAND circuit (NAND4) receives said on-and-off signal and signal passing via AND circuit (AND16) and others to light the lamp 9 on and off. The lamp 9 and the buzzer (BZ) issue an indicating signal to effect operation of the 2nd step. If the buttons 6, 7 are pushed by error instead of the button 5, the counter (CT2) is not provided with load with the signal passing via AND circuit (AND9) so that the output of said counter remains 0, 0, 0, and the motor (M) is stopped by the signal passing via AND circuit (AND14). When the button 6 is pushed as the 2nd step, the signals A, B are rendered 1, 0. OR circuit (OR7) is 0, and NAND circuit (NAND2) is 1, and the indicating lamp 9 is inoperative, and the lamp 9 is switched to continuous lighting. When the sewing machine is driven to form 7 stitches of the bar-tack, the sewing machine stops, and the output of the counter (CT7) is 0 1 1. The indicating lamp 9 turns off and the lamp 10 lights on and off, and the buzzer (BZ) works. When the button 7 is pushed as the 3rd step, the signals A, B are 1, 1. Similarly, the buzzer (BZ) is inoperative, the lamp 10 is switched to continuous lighting. The latch circuit (BH3) is opened at its gate by the signal passing via AND circuit (AND8) and others and gives to the comparator (COMP) the number of said stitches of the left line-tack. When the sewing machine is driven to form stitches of the left line-tack and the value of the counter (CT1) meets the number of stitches, the comparator (COMP) outputs 1 to stop the motor (M) and renders the output of the counter (CT2) 1 0 0. The lamp 10 turns off, the buzzer (BZ) works, and the lamp 9 lights on and off. When the button 6 is pushed as the 4th step, the buzzer (BZ) is inoperative, similarly to the 2nd step, and the lamp 9 is switched to continuous lighting. When the sewing machine is driven to form 7 stitches, the sewing machine stops, and the output of the counter (CT2) is 0 0 0. The lamp 9 turns off and only the lamp 3 lights. The 2nd buttonhole is finished, and under this condition the machine is ready for subsequent stitching. In subsequent buttonhole stitching, when the 1st step is performed, the motor does not work, as mentioned, and if the buttons 5, 6, 7 are pushed by error during operation of the 2nd to 4th steps, OR circuit (OR7) is 1, and the motor (M) is inoperative, and the buzzer (BZ) works, and the lamps 8, 9 are in continuous on-and-off lighting to indicate abnormal operation. The designation of memorization is cancelled by re-pushing the memory designation button 2, and the lamps 3 turns off.

According to the present invention, when the buttonhole of the desired size is once formed, the number of stitches are stored and subsequent buttonhole stitchings are indicated by designation in each of the respective steps, and erroneous operation is indicated so that an error could not be made in the stop order and stitches are formed by designation of each of the steps in accordance with the operating order, whereby the size of each buttonhole is made the same.

It will be understood that each of the elements described above, or two or more together, may also find a useful application in other types of sewing machines differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sewing machine of a type including a machine motor and an automatic buttonhole stitching device having a plurality of pattern cams selectively operated to form a series of stitches of a buttonhole in predetermined sequential steps, the buttonhole stitching device comprising:

pattern selecting means including a predetermined number of pattern cam selecting buttons selectively operated to select said pattern cams;

switch means operated in association with the selective operation of said pattern cam selecting buttons to produce buttonhole sequence signals indicating predetermined sequential steps for forming the stitches of the buttonhole;

electronic control means responsive to the buttonhole sequence signals of the switch means for storing a number of stitches formed in each sequential step for once produced buttonhole to thereby control the following formation of buttonhole stitches;

detecting means responsive to the buttonhole sequence signals of said switch means and to an output of said electronic control means to produce sequence detecting signals; and indicating means responsive to the sequence detecting signals of said detecting means to indicate the sequential steps of stitching the buttonhole.

2. A sewing machine as defined in claim 1, wherein said electronic control means includes a plurality of memory elements each temporarily storing the number of stitches of one part of the buttonhole, another memory element for permanently storing another part of the buttonhole stitches, a first counter operated in synchronism with a stitching operation of the sewing machine to incrementally count up the stitches of the buttonhole to be formed and a comparator for comparing the incremental count of the first counter and the number of stitches stored in said plurality of memory elements and in said another memory element in each sequential step of buttonhole stitching and producing an output to stop the sewing machine when the incremental count of the first counter comes to coincide with the number of stored stitches.

3. A sewing machine as defined in claim 1, wherein said detecting means includes a second counter which is responsive to the buttonhole sequence signals to produce an output to cause said indicating means to be operative, said second counter responsive to the output of said electronic control means to produce another output to cause said indicating means to be inoperative.

* * * * *